US006644234B2

(12) United States Patent
Awashima et al.

(10) Patent No.: US 6,644,234 B2
(45) Date of Patent: Nov. 11, 2003

(54) HOLDING APPARATUS FOR A FLOATING HOSE

(75) Inventors: Yuji Awashima, Abiko (JP); Masaaki Kawabata, Chita-gun (JP); Yuji Nakashima, Aki-gun (JP); Masahiro Itabashi, Yokohama (JP); Kenji Kochi, Kure (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 72 days.

(21) Appl. No.: 10/020,645

(22) Filed: Oct. 30, 2001

(65) Prior Publication Data

US 2002/0104471 A1 Aug. 8, 2002

(30) Foreign Application Priority Data

Feb. 6, 2001 (JP) ..... 2001-029707
Feb. 6, 2001 (JP) ..... 2001-029708

(51) Int. Cl.[7] ..... B63B 35/00
(52) U.S. Cl. ..... 114/382; 441/4
(58) Field of Search ..... 175/52, 85; 166/77.51; 211/70.4, 126.2; 441/3–5; 114/74 R, 382

(56) References Cited

U.S. PATENT DOCUMENTS 3,742,536 A * 7/1973 Sada et al. ..... 114/230
3,766,938 A * 10/1973 Stracke et al. ..... 137/355.16
3,945,497 A * 3/1976 Greenberg ..... 211/60 R
4,446,892 A * 5/1984 Maxwell ..... 138/104
5,803,779 A * 9/1998 Horton, III ..... 441/4

* cited by examiner

*Primary Examiner*—Ed Swinehart
(74) *Attorney, Agent, or Firm*—Fish & Richardson P.C.

(57) ABSTRACT

The present invention provides a holding apparatus for a floating hose which holds the floating hose which is provided with a floating unit when the floating hose is not used. The holding apparatus for a floating hose comprises a hose lifting device which lifts up the floating hose on the floating unit; a hose dividing device which divides the floating hose into a plurality of hose segments; a hose transfer device which transfers the hose segments; and a hose rack which holds the hose segments which were transferred by the hose transfer device. Furthermore, the apparatus further comprises a flange holding device which holds the end of the floating hose when the floating unit is not required to be entirely lifted on the floating unit, and a connector which connects the end of the floating hose to the receptacle of the floating unit.

8 Claims, 9 Drawing Sheets

HOLDING APPARATUS FOR A FLOATING HOSE

BACKGROUND OF THE INVENTION

1. Field of the Invention

The present invention relates to a holding apparatus for a floating hose for holding a floating hose which is used for loading and offloading a floating unit on the water which produces or stores crude petroleum or gas and the like.

2. Description of the Related Art

Floating units on the water such as a FPSO (Floating Production Storage and Offloading unit) or a FSRU (Floating Storage and Re-gasification Unit) are provided with long floating hoses, and loading and offloading of liquefied natural gas, liquefied propane gas, or crude petroleum between the units and tankers are performed by the floating hoses. When the floating hoses are not used, each hose is left floating on the water after it was released from the tanker, or is lifted up and left on the deck of the floating unit, or is lifted up and stacked on the deck as a plurality of hose segments which are provided by dividing the floating hose. In addition, the floating hose which has been lifted up on the deck, is not stowed or anchored on the deck.

However, in case that the floating hose is left on the water, crude petroleum which remains in the hose may leak out, or the floating hose may be damaged by being struck by ships or by the shock from waves in stormy weather, and crude petroleum or gas may escape from damaged hose when the loading or offloading is performed. Furthermore, the washing operation for the floating hose is not easy and waste fluid which was produced by the washing may leak out from a washing unit for the floating hose.

Meanwhile, in the case in which the floating hose is lifted up on the deck, the operation for lifting up all the floating hose, which is very long, requires a great deal of labor, and it is necessary to provide a large space on the deck to store the floating hose which has been lifted up. When the floating hose is divided into hose segments and is stacked on the deck, they can be stored within a relatively small space; however, the hose may be damaged during the operations for dividing the floating hose into the hose segments or for stacking the hose segments. Furthermore, since the hose segments are stacked on the same place, it is difficult to inspect each hose segment, and it is difficult to remove a damaged hose segment among the stacked hose segments when damaged hose segment is found as a result of an inspection. Moreover, the floating hose on the deck may be damaged and disturb other operations on the deck since the floating hose is not stowed or anchored and moves on the deck according to the motions of the floating unit in stormy weather.

The present invention is provided in consideration to the above circumstances, and an object of the present invention is to provide a holding apparatus for a floating hose which holds the floating hose in order to prevent damage to the floating hose and the leaking out of waste which remains in the floating hose without requiring a large space. Furthermore, another object of the present invention is to provide a holding apparatus for a floating hose which prevents the movement of the floating hose on the deck and easily enables inspection and removal of damaged hose segments without requiring a large space when all of the floating hose is lifted up on the deck.

SUMMARY OF THE INVENTION

In order to achieve the above objects, the present invention provides a holding apparatus for a floating hose which holds the floating hose which is provided with a floating unit when the floating hose is not used.

That is, the holding apparatus for a floating hose in a first aspect of the present invention comprises: a hose lifting device which lifts up the floating hose on the floating unit; a hose dividing device which divides the floating hose into a plurality of hose segments; a hose transfer device which transfers the hose segments; and a hose rack which holds the hose segments which were transferred by the hose transfer device.

According to the holding apparatus for a floating hose, since the long floating hose is divided by the hose segments and is stowed and anchored in the hose rack, the floating hose does not move on the deck when the floating unit moves in stormy weather. Furthermore, the space for storing the floating hose is reduced. In addition, since the hose segments are stowed in the hose rack without being directly stacked one on the other, damage to stowed hose segments can be prevented, and the hose segments can be easily inspected and removed. Moreover, a variety of hose segments can be managed with high efficiency by using the hose rack.

When each hose segment has flanges on both ends thereof and the floating hose is provided by connecting the hose segments by joining the flanges to each other, it is preferable that the hose dividing device have a hose segment supporting device which supports one of the connected hose segments and a traction device which pulls the other of the connected hose segments.

In this case, since the hose dividing device supports one of the connected hose segments and pulls the other of the connected hose segments, the floating hose can be divided with high efficiency while preventing the fall of the hose segment into the sea.

Furthermore, it is preferable that a plurality of hose racks which can be piled up one atop the other be provided.

In this case, the space for storing the floating hose can be further reduced by piling up hose racks one atop the other.

The holding apparatus for a floating hose according to a second aspect of the present invention comprises: a hose lifting device which lifts up an end portion of the floating hose; and a hose end holding device which holds the end portion of the floating hose which was lifted up by the hose lifting device.

According to the holding apparatus for a floating hose, by lifting up and holding the end of the floating hose, the floating hose can be held with the floating unit without providing a large space, and damage of the floating hose and the leakage of waste which remains in the floating hose can be prevented.

In the holding apparatus for a floating hose, when a flange is provided on an end of the floating hose, it is preferable that the hose lifting device have a davit which is provided on the floating unit, a jib which is swingably provided on the davit and hangs the flange, and a lifter which lifts up the flange which was hung by the jib; and the hose end holding device is a flange holding device which holds the flange which was transferred to a predetermined position by the jib.

In this case, since the jib can be stowed in the floating unit by swinging the davit around, the space for the jib is saved and damage to the jib is prevented. Furthermore, since the floating hose is easily held by holding the flange which is provided on the end of the floating hose at the predetermined position located on the swinging path of the jib, the operability of the holding apparatus for a floating hose is improved.

Furthermore, in the holding apparatus for a floating hose, it is preferable that the floating unit have a receptacle and that the hose end holding device have a connector which connects the end of the floating hose to the receptacle.

In this case, the floating hose forms a closed loop by connecting another end of the floating hose in which one end thereof is connected with the floating unit to the receptacle. As a result, the floating hose can be held without the crude petroleum or waste which remains in the floating hose leaking, and a washing operation for the floating hose can be performed with high efficiency.

DESCRIPTION OF THE PREFERRED EMBODIMENTS

Preferred embodiments will be presented in the following with reference to the figures.

Figure 1:
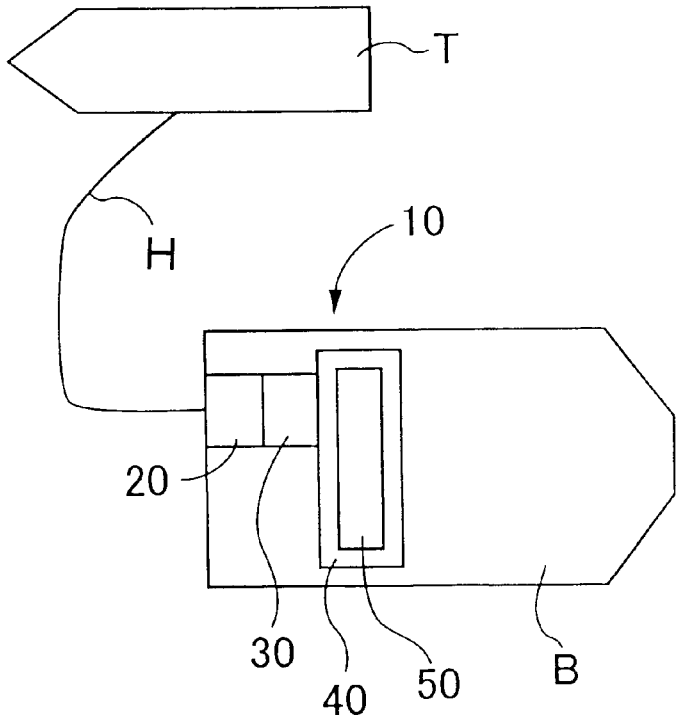
FIG. 1 is a schematic diagram of an embodiment of the floating unit which is equipped with the holding apparatus for a floating hose of the present invention.

FIG. 1 is a schematic diagram of an embodiment of a holding apparatus for a floating hose 10 (hereinafter abbreviated to "holding apparatus") of the present invention which is provided with a floating unit B on the water. The holding apparatus 10 is provided for stowing a floating hose H which is used for loading and offloading crude petroleum and the like between the floating unit B and a tanker T, and has a hose lifting device 20, a hose dividing device 30, a hose transfer device 40, and a hose rack 50.

Figure 2:
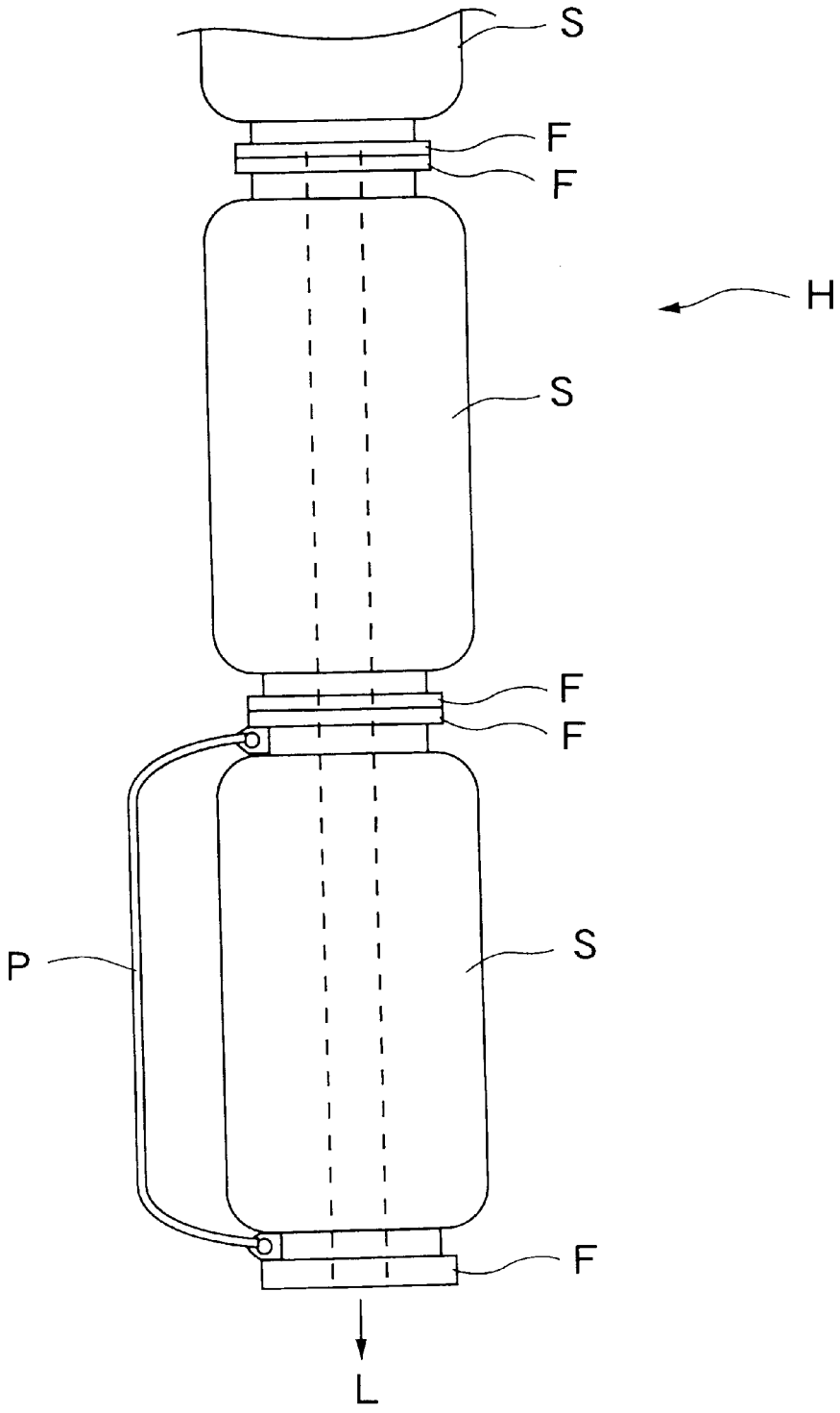
FIG. 2 is a partial side view of an embodiment of the floating hose which is provided by connecting the hose segments.
Figure 3:
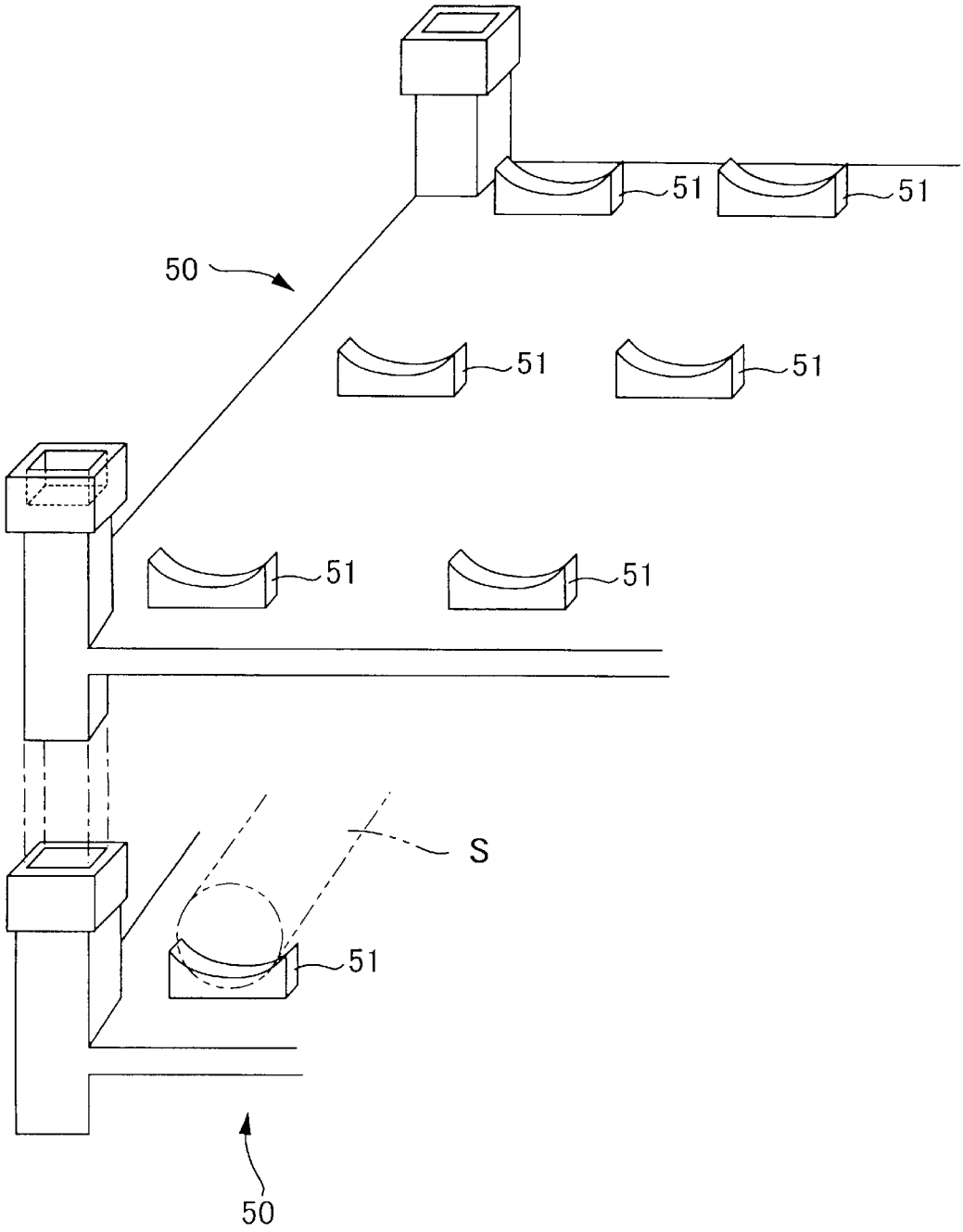
FIG. 3 is a perspective view of an embodiment of the hose racks of the holding apparatus for a floating hose of the present invention.

The floating hose H is, as shown in FIG. 2, provided by connecting a plurality of hose segments S by joining flanges F which are provided on both ends of each hose segment S, and each end of the floating hose H is connected to a loading aperture L of the floating unit B or a loading pipe (not shown) of the tanker T via the flanges F. Furthermore, a pick-up chain P is provided with the hose segment S which is located at each end of the floating hose H.

Here, since the strength and functions which are required for the floating hose H vary in accordance with the position at which the floating hose H is connected to another member or floats on the water, a variety of floating segment S having different strengths and functions are generally used in another similar segments of the floating hose H. However, the same kind of floating segments S are shown in this figure.

The hose rack 50 which is provided for holding the hose segments S, has a plurality of segment holders 51, and a predetermined number of the hose segments S can be held by the segment holders 51. Furthermore, in this embodiment, a plurality of hose racks 50 which can be transferred and be piled up one atop the other are provided, and these hose racks 50 are provided in a plurality of positions on the floating unit B in order to stow all the floating segments S.

Here, in this figure, the hose racks 50 having the segment holders 51 for holding the same kind of floating segments S are shown; however, since a variety of floating segment S having different shapes are generally used as described above, the segment holders 51 having a variety of shapes in compliance with the shapes of floating segments S are provided on each hose rack 50 in practice.

Figure 4:
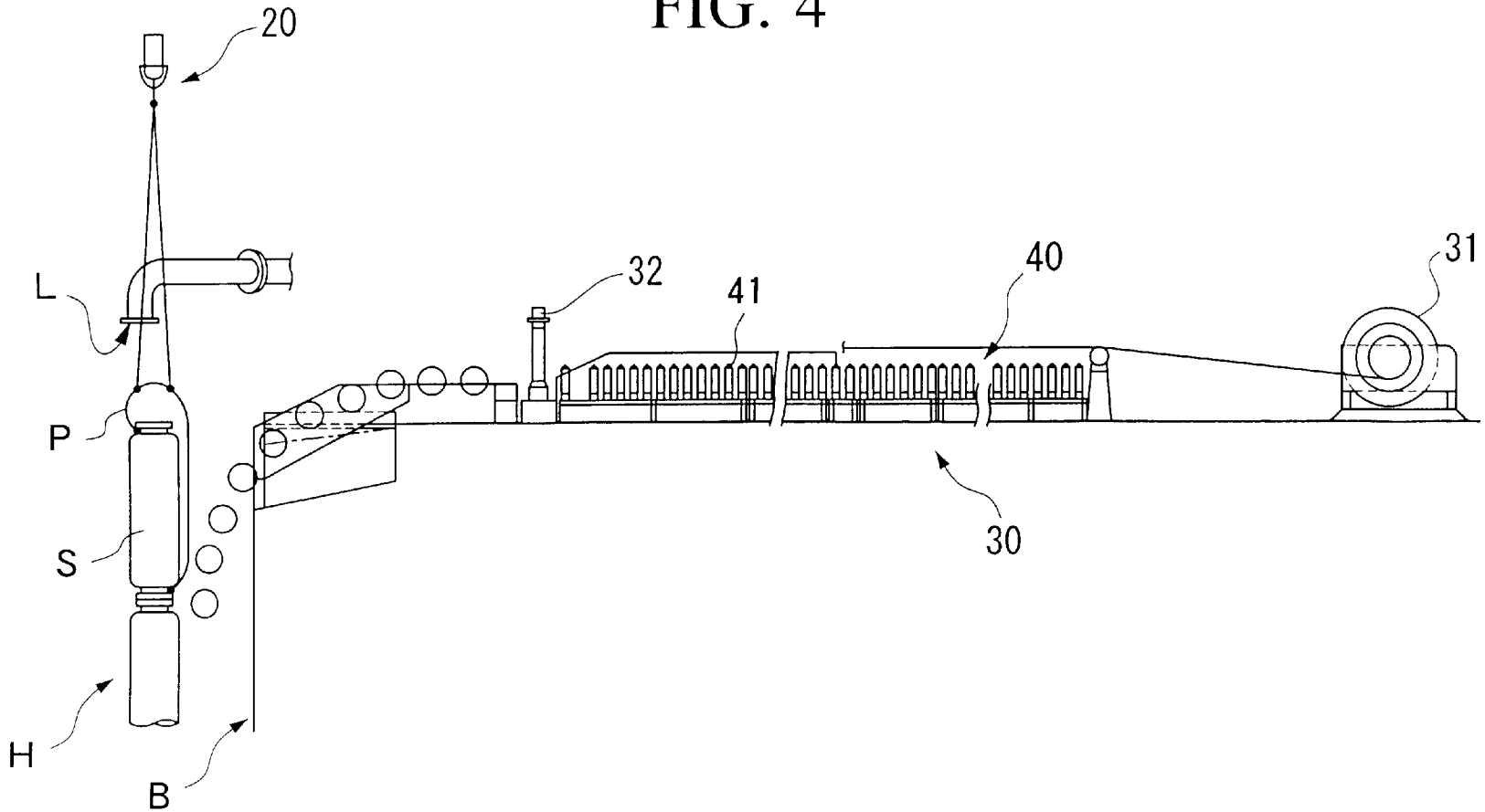
FIG. 4 is a side view of an embodiment of the hose lifting device and hose dividing device of the holding apparatus for a floating hose of the present invention.

The hose lifting device 20 is a crane for lifting the hose segment S from the surface of the water by lifting up the pick-up chain P of the hose segment S which is located at the end of the floating hose H as shown in FIG. 4, and transfers the floating hose H to the hose dividing device 30.

The hose dividing device 30 has a winch (traction device) 31 for pulling the floating hose H and a hose segment supporting device 32 for supporting the flange F of the hose segment S. When dividing the floating hose H using the hose dividing device 30, at first, pulling the hose segment S which is located at the end of the floating hose H by the winch 31; and supporting the flange F which is located at the forward end (end of the floating unit B side) of the hose segment S which is located at the backward side (tanker T side) of the segment S which was pulled by the winch 31, by the hose segment supporting device 32; and dividing the hose segment S which is located at the end of the floating hose H by releasing the connection of the flange F. The divided hose segment S is transferred to a trough 41 of the hose transfer device 40. Next, pulling the hose segment S which is held by the hose segment supporting device 32 and is newly located at the end of the floating hose H by the winch 31; and supporting the flange F which is located at the forward end of the hose segment S which is located at the backward side of the segment S which was pulled by the winch 31, by the hose segment supporting device 32; and dividing the hose segment S which is located at the end of the floating hose H by releasing the connection of the flange F. The floating hose H can be successively divided by repeating the above procedure.

Figure 5:
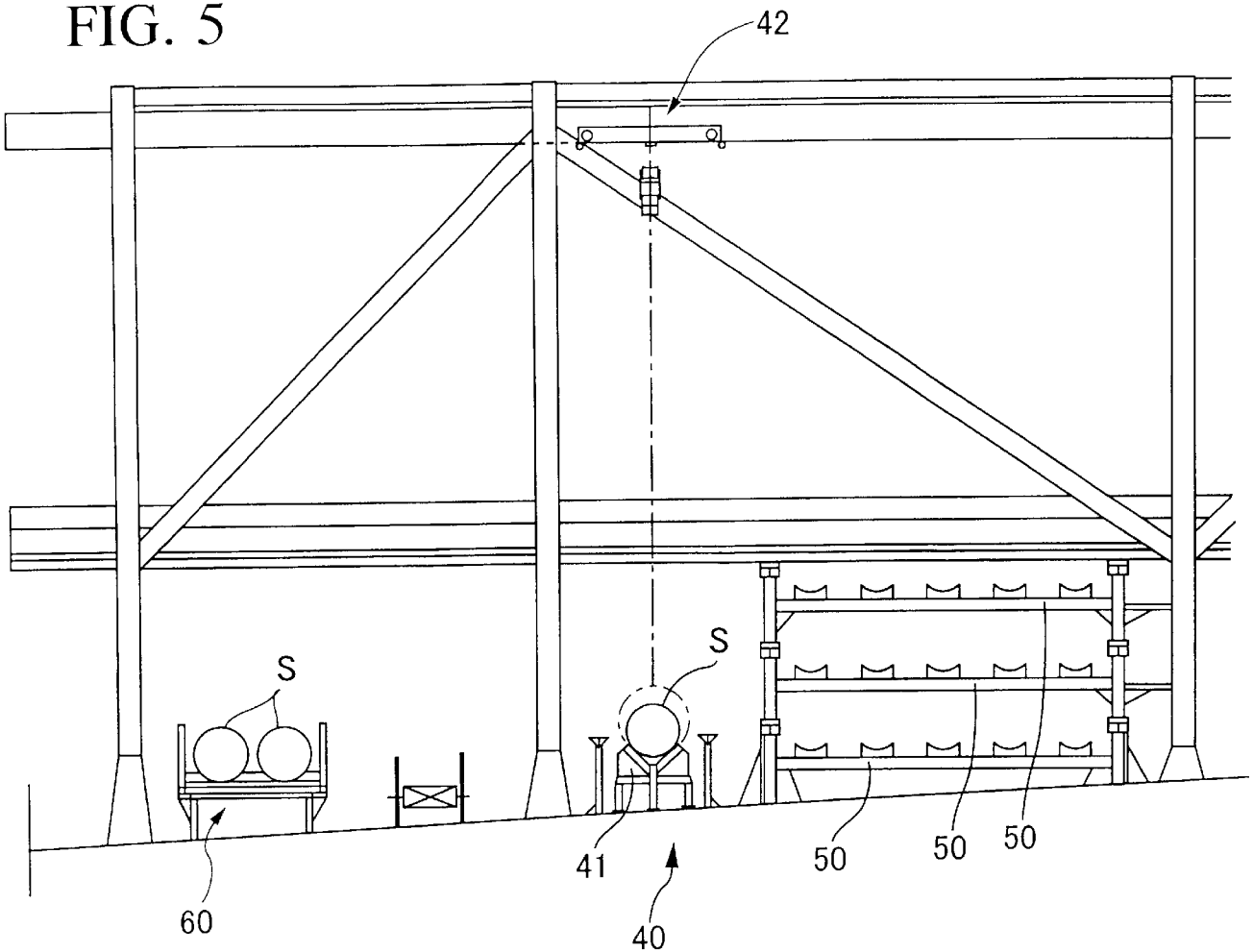
FIG. 5 is a front view of an embodiment of the hose transfer device and hose racks of the holding apparatus for a floating hose of the present invention.

The hose transfer device 40 has the above-mentioned troughs 41 and a gantry crane 42 as shown in FIG. 5. The trough 41 is provided for transferring the divided hose segment S from the hose dividing device 30 to the foot of the gantry crane 42. The gantry crane 42 is provided so as to horizontally move on the deck in which the hose racks 50 are located in order to transfer the hose segment S onto the hose rack 50 one by one and to move the hose racks 50.

By the holding apparatus 10 having the above-described devices, the floating hose H is divided and stowed in accordance with the following procedure.

First, removing the floating hose H from the loading aperture L of the floating unit B, and lifting up the pick-up chain P of the hose segment S which is located at the end of the floating hose H and transferring the end of the floating hose H to the hose dividing device 30 using the hose lifting device 20.

Next, the floating hose H is successively divided into the hose segments S using the hose dividing device 30, and the hose segments S are transferred onto the hose rack 50 one by one using the hose transfer device 40. Each hose segment S transferred onto the hose rack 50 is held by the segment holder 51 which is adapted to the shape of each hose segment S. The hose rack 50 which holds the hose segments S is moved and piled up by the gantry crane 42 so as to be efficiently arranged on the deck of the floating unit B.

The hose segments S which have been divided and stowed in the hose rack 50 can be used as the floating hose H for loading and offloading between the floating unit B and the tanker T by connecting the hose segments S in accordance with a reverse procedure of the above procedure.

Furthermore, when damage is found in the hose segments S which are held by the hose rack 50 as a result of an inspection, damaged hose segment S is transferred to a hose pallet 60 shown in FIG. 5 using the gantry crane 42. Similarly, a new hose segment S can be transferred from the hose pallet 60 to the hose rack 50 using the gantry crane 42.

As described above, according to the holding apparatus 10, since the floating hose H is divided into the hose segments S and is reliably stowed and anchored in the hose rack 50 which can be piled on another hose rack 50, the floating hose H can be safely stowed and anchored, and the space on the deck of the floating unit B can be effectively utilized.

In addition, the shapes and the combination of the devices disclosed in the above embodiment are only an example of the present invention, and can be changed in compliance with a change of design and the like within the scope of the present invention. For example, the floating hose H which has been lifted on the floating unit B is simultaneously divided into the hose segments S in the embodiment as shown in the figures; however, the floating hose H may be divided into the hose segments S after the floating hose H was entirely lifted onto the floating unit B.

Meanwhile, when the floating hose H is not required to be entirely lifted on the floating unit B, the holding apparatus as described below can be used.

Figure 6:
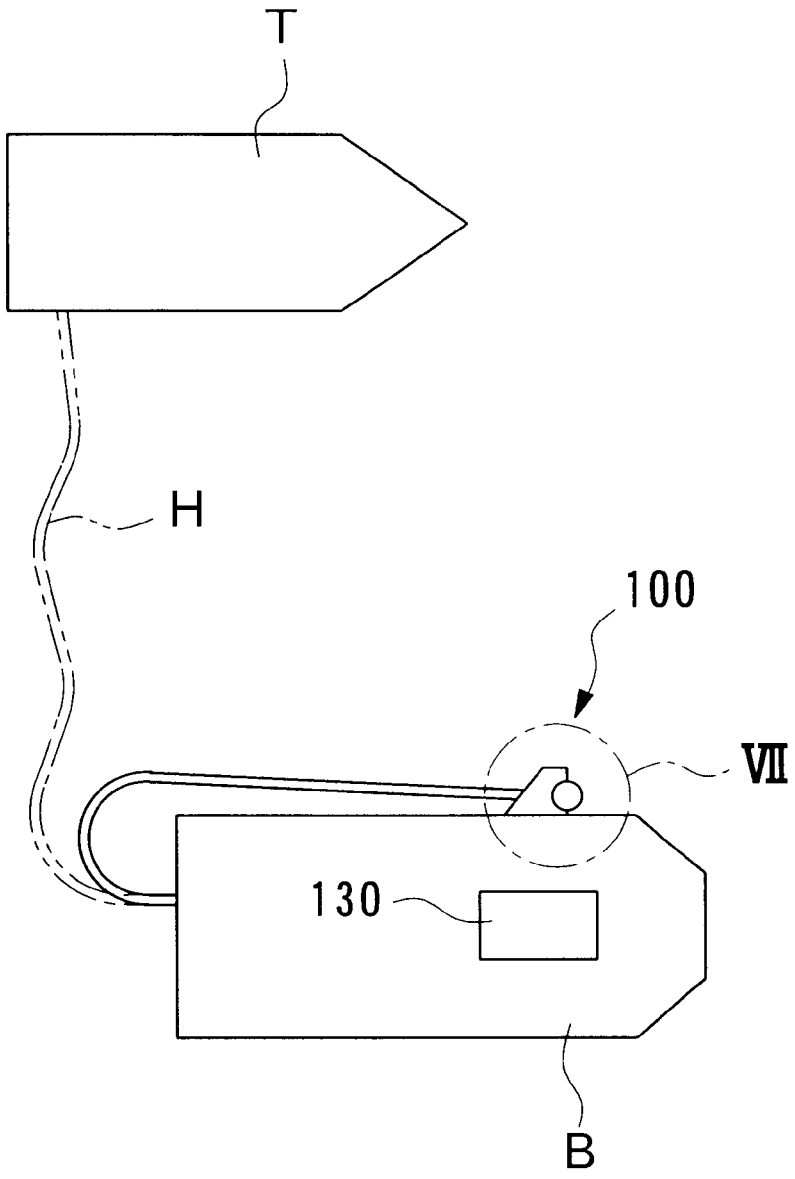
FIG. 6 is a schematic diagram of an embodiment of the floating unit which is equipped with the holding apparatus for a floating hose of the present invention.

FIG. 6 is a schematic diagram of an embodiment of a holding apparatus 100 of the present invention which is provided with the floating unit B. The floating unit B produces and stores crude petroleum or gas and the like, and unloads the crude petroleum or gas and the like to the tanker T through the floating hose H. During the operation, the end at the floating unit B side of the floating hose H is connected with a tank of the floating unit B and the end at the tanker T side of the floating hose H is connected with the loading pipe of the tanker T. When the unloading is finished, the connection between the tanker T and the floating hose H is released and the released end of the floating hose H is towed to the floating unit B by a tugboat and the like (not shown).

Figure 7:
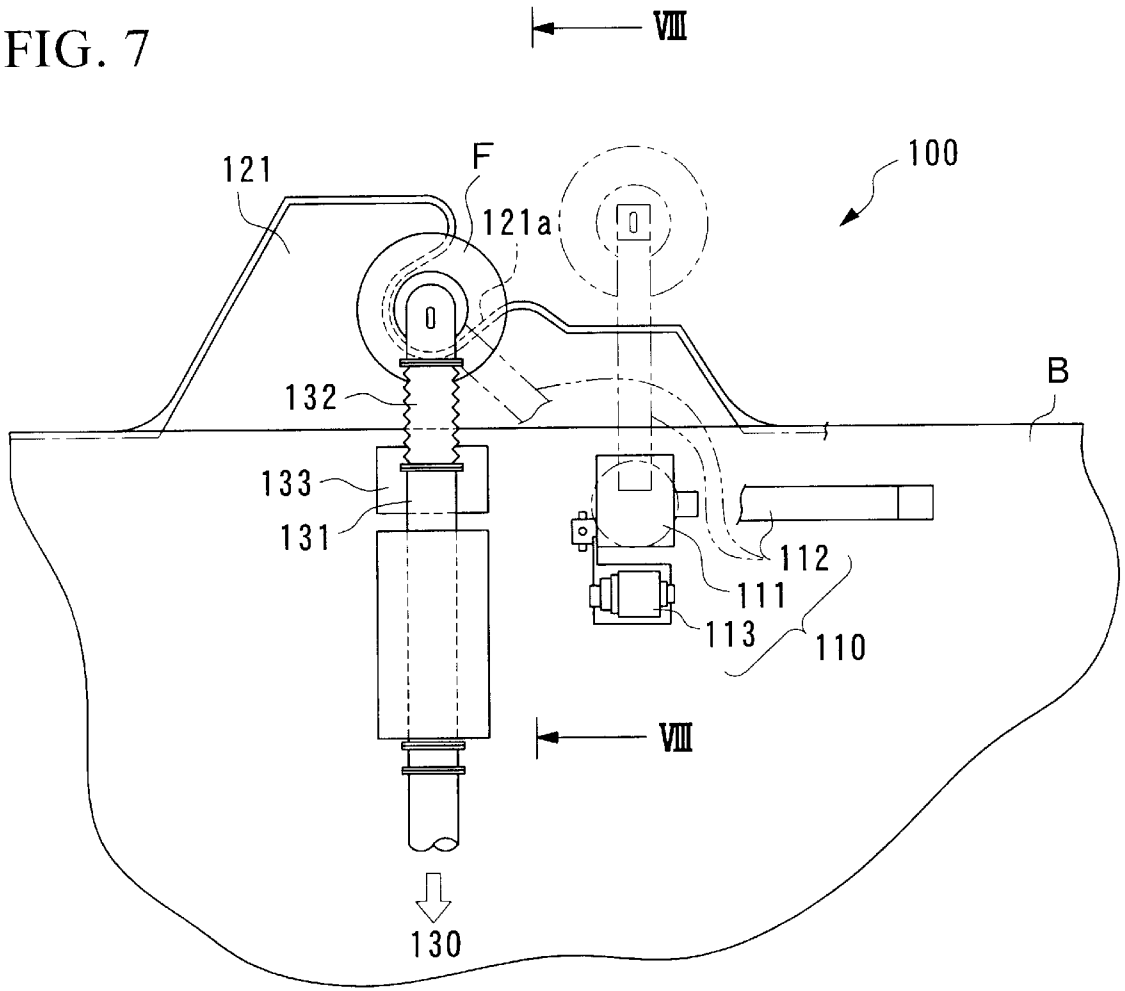
FIG. 7 is an enlarged view of the part which is denoted by VII in FIG. 6 for showing the holding apparatus for a floating hose of the present invention.

The holding apparatus 100 is shown in FIG. 7. The holding apparatus 100 is provided for lifting up the end of the floating hose H which was towed by the tugboat on the floating unit B by the hose lifting device 110, and holding the flange F of the lifted floating hose H to a flange holding device (hose end holding device) 120. The floating unit B has a floating hose washing tank (receptacle) 130, and the lifted floating hose H can be connected to the floating hose washing tank 130 via the flange holding device 120.

The hose lifting device has a floating hose davit 111, a jib 112, and a winch (lifter) 113. The floating hose davit 111 is a post provided on the deck of the floating unit B and is swingably supporting the jib 112. A wire (not shown) of the winch 113 is led on the jib 112 and suspended from the tail end of the jib 112, and the wire can be wound by the winch 113. Furthermore, as shown in FIG. 7, the jib 112 can be located three positions: a hose lifting position in which the jib 112 projects from the broadside of the floating unit B, a stowed position in which the jib 112 is stowed on the floating unit B, and a holding position for holding the flange F which is held by the jib 112 to the flange holding device 120, by swinging the davit 111 around. By swinging the jib 112 to the stowed position, damage to the jib 112 caused by being struck by a ship and the like is prevented.

Figure 8:
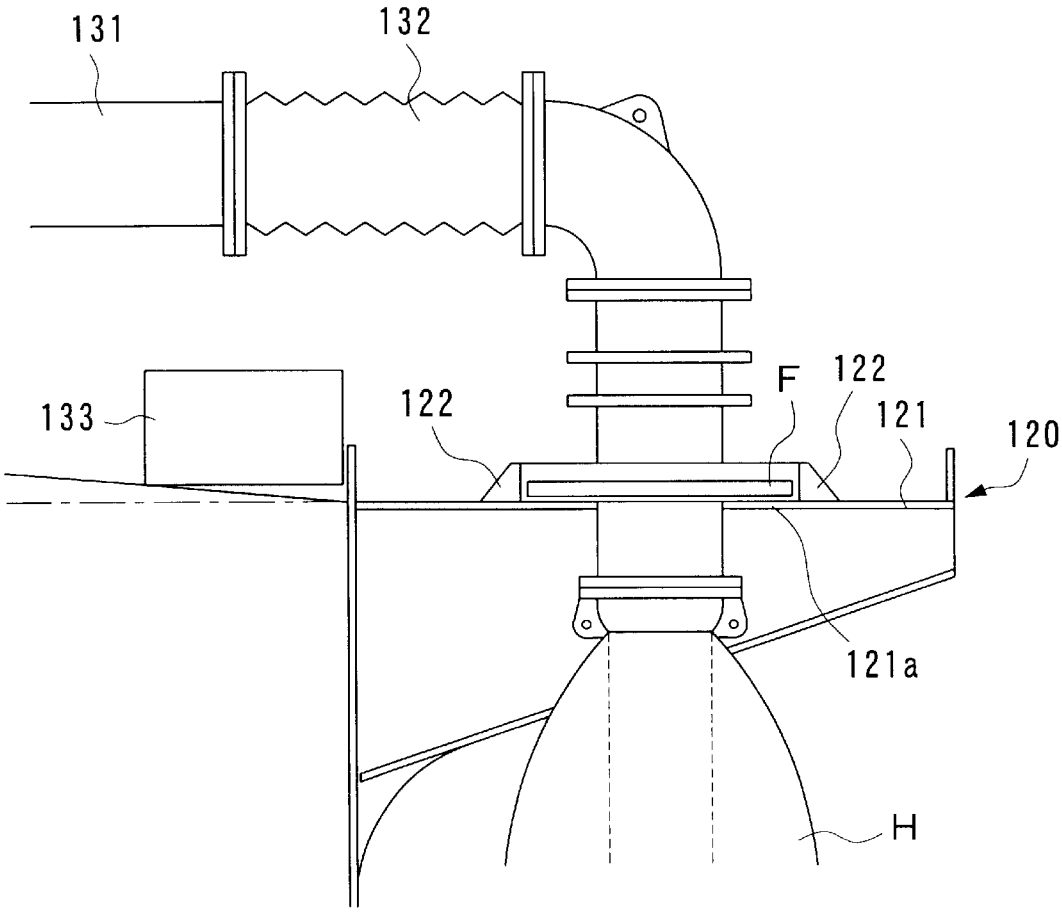
FIG. 8 is a cross sectional view along line VIII—VIII in FIG. 7.

The flange holding device 120 is shown in FIGS. 7 and 8. The flange holding device 120 has a platform 121 which is provided on the broadside of the floating unit B, and a flange holder 121*a* which enables holding the flange F of the floating hose H is formed at the platform 121. The flange holder 121*a* is a concave portion which forms a U-shape as it shown from the upper side and opens along the swinging path (of the flange F) of the floating hose H which is hung from the tail end of the jib 112, and the width of the flange holder 121 is determined in order that the thin portion (hose segment S) of the floating hose can be passed and the thick portion (flange F) of the floating hose cannot be passed. Furthermore, a plurality of flange fasteners 122 for fastening the flange F on the platform 121 are provided around the flange holder 121*a* (in this embodiment, seven flange fasteners 122 are provided). The flange fasteners 122 are provided on the platform 121 so as to surround the flange at predetermined intervals.

Figure 9:
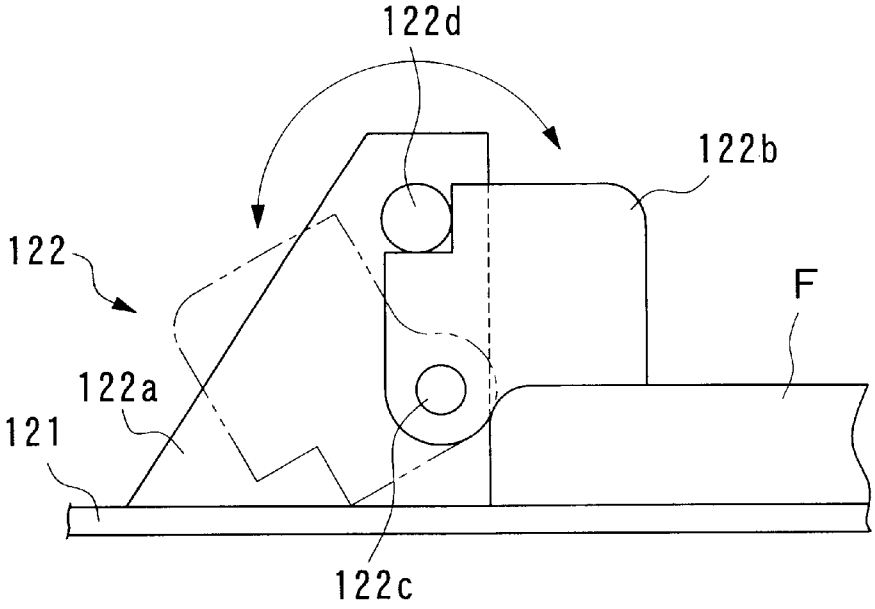
FIG. 9 is a side view of an embodiment of the flange fastener of the holding apparatus for a floating hose of the present invention.

As shown in FIG. 9, each flange fastener 122 has a stay 122*a*, a plate 122*b* which is rotatively connected with the stay 122*a* by a hinge pin 122*c*, and a fastening pin 122*d* which is laid on the plate 122*b* for fastening the plate 122*b*. The flange F of the floating hose H which is laid on the flange holder 121*a* by connecting the floating hose H to the flange holder 121*a* from the upside, is pressed downward by the plate 122*b* by rotating the plate 122*b* and the outer peripheral part of the flange F is sandwiched between the platform 121 and the plate 122*b*. In addition, the plate 122*b* is fastened by the fastening pin 122*d*, and as a result, the flange F is fastened on the platform 121 so as to open the floating hose H upward.

Furthermore, the flange holding device 120 has a joining pipe (connector) 131. One end of the joining pipe 131 is connected to the above-mentioned floating hose washing tank 130 of the floating unit B, and another end of the joining pipe 131 is connected to the flange F of the floating hose H which has been held by the flange holding device 120 through a flexible hose 132. In addition, reference numeral 133 denotes a oil tray which is provided under the connecting portion between the joining pipe 131 and the flexible hose 132, for preventing the leaking out of crude petroleum or the waste fluid which was produced by the washing from the connecting portion to the outboard of the floating unit B.

By the holding apparatus 100, the floating hose H is held with the floating unit B in accordance with the following procedure. Here, as described above, the end at the floating unit B side of the floating hose H is connected with the crude petroleum tank of the floating unit B. The flange F which is provided at the end of the floating hose H which was towed from the tanker is connected with the wire which is suspended from the jib 112 which has been swung to the hose lifting position, and the flange F is held by the tail end of the jib 112 as a result of winding the wire by the winch 113. Next, the jib 112 which holds the flange F is swung to the holding position, and the flange F is connected with the flange holder 121*a* from the upside by playing out the wire from the winch 113 and moving the flange F downward at the holding position. Then, the flange F is fastened to the platform 121 by the flange fastener 122, and as a result, the flange F is held by the flange holding device 120. After that, the wire is released from the flange F and the jib 112 is swung to the stowed position.

The floating hose H which is held by the flange holding device 120 is connected to the joining pipe 131 which is provided on the floating unit B through the flexible hose 132 as shown in FIGS. 7 and 8. As described above, since the joining pipe 131 is connected to the floating hose washing tank 130 of the floating unit B, the interior of the floating hose H can be washed while preventing the leakage of the waste fluid which was produced by the washing to the floating unit B, by connecting the floating hose H to the joining pipe 131 through the flexible hose 132.

That is, by holding the end of the floating hose H with the holding apparatus 100, the floating hose H can be held with the floating unit B without providing a large space, and damage to the floating hose H and the leakage of waste which remains in the floating hose H can be prevented.

Furthermore, by connecting the floating hose H which is held by the holding apparatus 100 to the floating hose washing tank 130, the interior of the floating hose H can be washed while preventing the leakage of the waste fluid.

Moreover, damage to the floating hose H can be prevented more reliably by lifting up the floating hose H on the floating unit B from the end thereof which is connected with the floating unit B using a stowing apparatus for the floating hose H, while holding another end of the floating hose H which was towed from the tanker by the holding apparatus 100. In this case, the holding apparatus 10 as shown in FIGS. 1 to 5 can be used as the stowing apparatus.

In addition, the shapes and the combination of the devices disclosed in the above embodiment are only examples of the present invention, and they can be changed in compliance with a change of design and the like within the scope of the present invention. For example, the holding apparatus 100 can be applied with the floating units for liquefied natural gas or liquefied propane gas, as well as with the floating unit for produce and store crude petroleum. Furthermore, other types of receptacles can be provided as the receptacle of the present invention as well as the floating hose washing tank 130.

What is claimed is:

1. A holding apparatus to hold a floating hose provided with a floating unit on water when said floating unit is not used, said apparatus comprising:

a hose lifting device which lifts up said floating hose on said floating unit;

a hose dividing device which divides said floating hose into a plurality of hose segments;

a hose rack which holds said hose segments; and a hose transfer device to transfer said hose segments to said hose rack.

2. A holding apparatus for a floating hose according to claim 1, wherein each hose segment has a flange on each end thereof and said floating hose is provided by connecting said hose segments by joining said flanges each other, and said hose dividing device has a traction device to pull one of said connected hose segments and a hose segment supporting device to support another of said connected hose segments which is positioned at a backward side of the hose segment which was pulled by the traction device.

3. A holding apparatus for a floating hose according to one of claims 1 and 2, wherein a plurality of said hose racks which can be piled up one atop the other, are provided.

4. A holding apparatus for a floating hose according to claim 1, further comprising:

a hose end lifting device for lifting up an end portion of said floating hose; and a hose end holding device which holds an end portion of said floating hose which was lifted up by said hose end lifting device.

5. A holding apparatus for a floating hose according to claim 4, wherein a flange is provided on an end of said floating hose; said end hose lifting device has a davit which is provided on said floating unit, a jib which is swingably provided on said davit and hangs said flange, and a lifter which lifts up said flange which was hung by said jib; and said hose end holding device is a flange holding device which holds said flange which was transferred to a predetermined position by said jib.

6. A holding apparatus for a floating hose, according to one of claims 4 and 5, said floating unit having a receptacle and said hose end holding device having a connector which connects the end of said floating hose to said receptacle.

7. A holding apparatus for a floating hose according to claim 3 wherein each of said hose racks has a plurality of segment holders to hold respective hose segments.

8. A holding apparatus to hold a floating hose which is provided with a floating unit on water when said floating hose is not used, said apparatus comprising:

a hose end lifting device to lift up an end portion of said floating hose;

a hose end holding device to hold an end portion of said floating hose which was lifted up by said hose end lifting device, wherein a flange is provided on an end of said floating hose, said hose end lifting device has a davit which is provided on said floating unit, a jib which is swingably provided on said davit and hangs said flange, and a lifter to lift up said flange which was hung by said jib, and said hose end holding device is a flange holding device to hold said flange which was transferred to a predetermined position by said jib.

* * * * *